United States Patent [19]

Dowell

[11] 4,327,914

[45] May 4, 1982

[54] BASEBALL GAME APPARATUS

[76] Inventor: James R. Dowell, 5457 Peacock Ln., Riverside, Calif. 92505

[21] Appl. No.: 171,430

[22] Filed: Jul. 23, 1980

[51] Int. Cl.[3] ..... A63F 3/00

[52] U.S. Cl. ..... 273/93 C; 273/289; 273/294; 273/284

[58] Field of Search ..... 273/89, 90, 93 R, 93 C, 273/294, 244, 289, 298

[56] References Cited

U.S. PATENT DOCUMENTS

| | | | |
|---|---|---|---|
| 155,752 | 10/1874 | Richardson | 273/294 |
| 1,053,788 | 2/1913 | Crew | 273/89 |
| 1,502,189 | 7/1924 | Hatch | 273/89 |
| 1,685,428 | 9/1928 | Lowry | 273/89 |
| 2,088,492 | 7/1937 | Stowe | 273/93 C X |

*Primary Examiner*—George J. Marlo

[57] ABSTRACT

This game board, which is called "double-play," consists primarily of a playing surface inscribed with a "baseball diamond," score pads, scoring boxes, "dugouts," etc. The game further includes a deck of cards that are to be shuffled and played, and a multiple number of animated playing pieces, which are color coded, are provided for playing the game. The playing pieces include a first team of "right hand batters" and an opposing second team of "left hand batters". The baseball diamond includes a pair of boxes, one on each side of home plate, each being a different color, and a pair of adjacent boxes, each of a different color, located at the first, second, and third base positions.

3 Claims, 4 Drawing Figures

BASEBALL GAME APPARATUS

This invention relates to games, and more particularly, to a baseball game board.

It is, therefore, the principal object of this invention to provide a baseball game board, which will be a game of chance and skill, wherein two teams will be up to bat and battle for play.

Another object of this invention is to provide a baseball game board, which will be of such design, as to enable a player to bring in more runs than his opponent, in nine innings of play, while the player attempts to strike his opponent out.

Another object of this invention is to provide a baseball game board, which will consist of baseball plays, that are determined by the cards of each player.

A further object of this invention is to provide a baseball game board, which will be such that, in order to gain a play, each player must have three identical cards of any play (three of a kind).

Other objects of this invention are to provide a baseball game board game, which will be simple in design, inexpensive to manufacture, unique in design, and easy to play.

These, and other objects, will be readily evident upon a study of the following specification and the accompanying drawing wherein.

Figure 1:
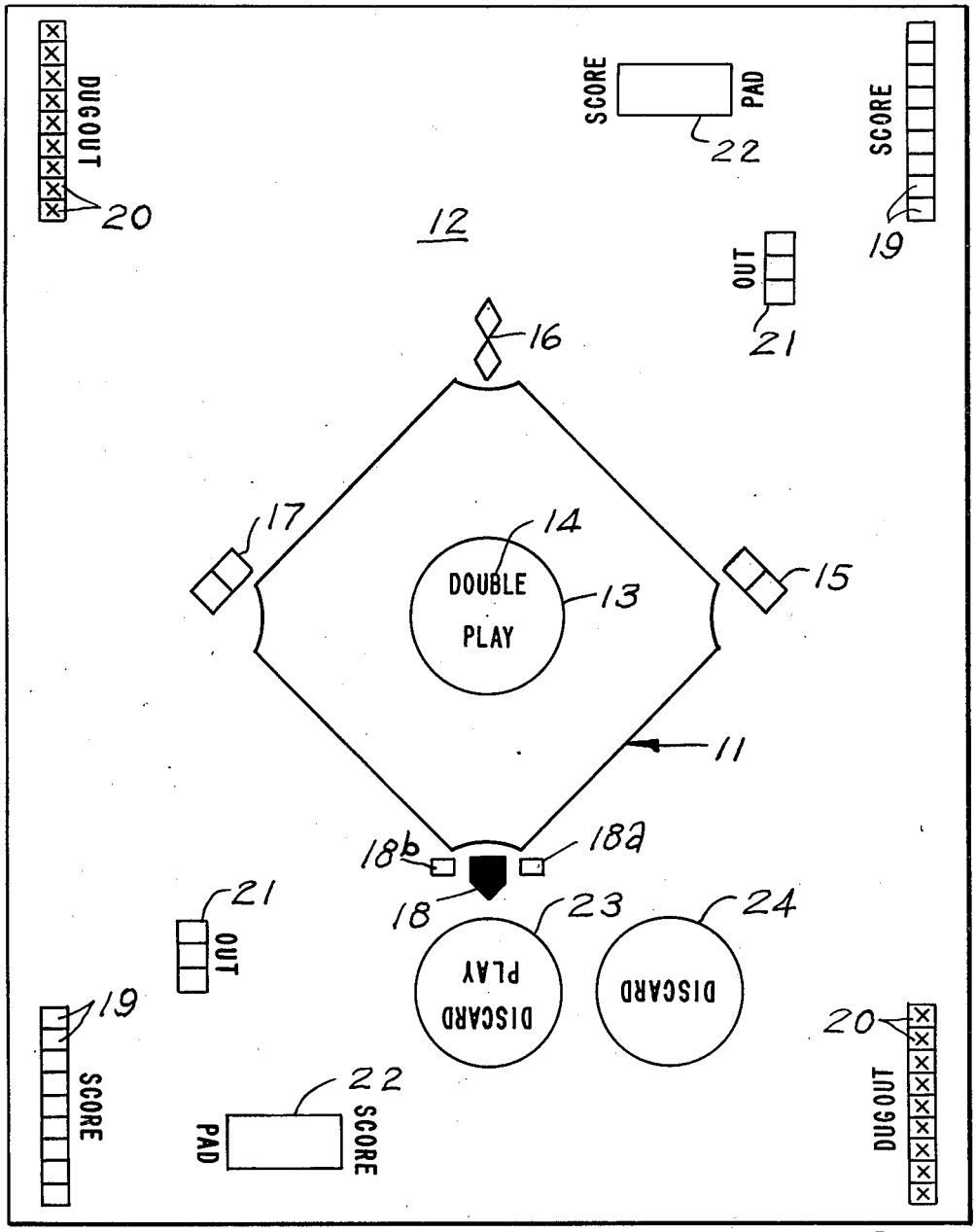
FIG. 1 is a top plan view of a game board, comprising the present invention.

According to this invention, a game board 10 is shown to include a baseball diamond 11, which is inscribed on the top surface 12. In the center of diamond 11 is inscribed a circle 13, with letter characters 14, indicating "double-play." On the respective corners of diamond 11 are boxes 15, 16, 17, and 18, which indicate "first base," "second base," "third base," and "home plate." In diagonal corners of surface 12 are inscribed a plurality of adjacent boxes 19, indicating the "score," and, in the other diagonal corners, are a plurality of adjacent boxes 20, imprinted with the latter character "X", alongside of which is imprinted "dugout." X=Baseball players.

Also imprinted on surface 12 are a pair of spaced-apart boxes 21 and 22, imprinted with the words "out," and "socre pad," respectively.

A pair of spaced-apart circles 23 and 24 are also imprinted on surface 12, and spell the words "discard" and "discard play," respectively.

Figure 2:
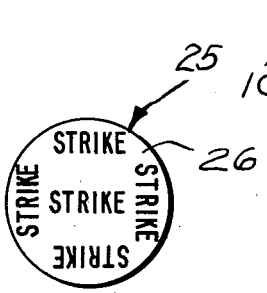
FIG. 2 is a top plan view of one of the playing cards, for use with the game board.
Figure 3:
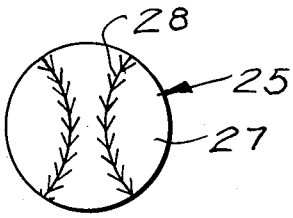
FIG. 3 is a bottom plan view of FIG. 2.

In FIGS. 2 and 3 of the drawing are illustrated one of the plurality of playing cards 25, which are 2½ inches in diameter. On one surface 26 of one card 25 thereof is imprinted the word "strike," for example and on the opposite surface 27 of all cards 25 thereof is imprinted arcuately configurated stitches 28, so as to resemble a baseball.

Figure 4:
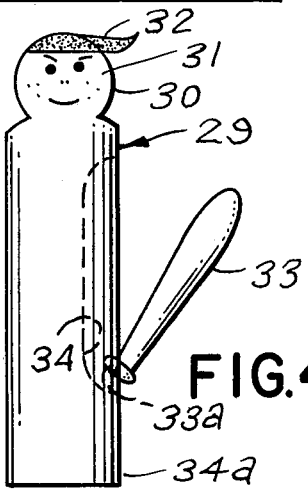
FIG. 4 is a front elevational view of one of the playing pieces of the present invention.

FIG. 4 illustrates one of a plurality of playing pieces 29, which are of solid cylindrical configuration, having a head 30, with a face 31, and a cap 32. Playing pieces 29, for one team, are designated as "left hand batters," which are color coded blue, and playing pieces 29, for the opposing team, are designated as "right hand batters," and are color coded red. Playing pieces 29 further include a bat 33, which is pivotal, by pin 33*a* means, in recess 34 of the body 34*a*.

The object of game board 10 is for one player to bring in more runs than his opponent, in nine innings of play, while one player attempts to strike him out. Game 10, "DOUBLE-PLAY," consists of baseball plays, as determined by the cards held by each player. In order to gain a play, each player must have three identical cards of any play, three of a kind.

PLAYING THE GAME (a) Each opponent places his ball player (playing piece) 29, in the respective batter's box 18, or 18*a*, and the remaining players 29, in the dugout (boxes 20).

(b) The deck of cards 25, consisting of plays, are then shuffled, and a draw for the high card 25 determines the player who will go first (i.e., single beats an out; triple beats a double, etc.).

(c) The remaining cards 25 are then placed on the pitcher's mound, and four more cards 25 are drawn by each player, for a total of five cards 25 held.

(d) If a play is drawn, it is played on the game board 10, and the player must wait his turn, to replace cards 25. It is then the opponent's turn to play. If no play is drawn, then the first player exchanges a card with his opponent.

(e) Once the card is exchanged with the opponent, and results in a play, it is then played on the game board 10, and the player must wait his turn, to replace cards 25. If not, then a card 25 is discarded, and another card 25 is drawn from the deck.

(f) If this results in a play, it must wait until the player's next turn to play on the game board 10.

(g) The opponent now takes his turn, following step "d," and repeating steps taken by the first player.

MOVES (h) To gain a play, each player must have three identical cards of any play, (three of a kind). The only exception is a "Double Play" card 25, which allows for a double base run, or it may be used against the opponent's players on bases 15, 16 or 17, for two "outs."

(i) All "run" cards 25 which a player holds, are used for his own ball players, and all "out" cards 25 are used against the opponent.

(j) Each player uses his respective color coded bases 15, 16 or 17, without effecting the player on the board 10.

(k) Each "out" must be indicated by placing a ball player piece 29 in the "out" boxes 21.

(l) The first player who receives three "outs" removes all playing pieces 29 from the bases 15, 16 or 17, and the opponent's playing pieces 29 remain, for the new inning.

(m) All played cards 25 (three of a kind) are placed face up in the circle 23 area marked "discard play."

(n) All discarded cards 25 are placed face down in the circle 24 area marked "discard." (This is to avoid your opponent's being aware of any cards 25 possibly held in your hand.)

(o) Ball playing pieces 29 are placed in score Boxes 19, after each scored "run," to indicate "score," and are then removed upon completion of an "inning." "Score pad" 22 is then used, to keep track of total score and "innings."

(p) The deck of cards 25 are reshuffled after all have been used, and game 10 continues.

It shall be noted, that the diamond 11 is colored green, home plate 18 is black, box 18*a* is red, box 18*b* is blue, bases 15, 16 and 17 are divided into red and blue, one of the set of "out" boxes 21 is red, and the other blue, the same being of the "score" boxes 19, and the "dugout" boxes 20.

While various changes may be made in the detail construction, it is understood that such changes will be within the spirit and scope of the present invention, as is defined by the appended claims.

What I now claim is:

1. A baseball game comprising a game board including a baseball diamond, a plurality of mechanical playing pieces to be positioned on said game board for scoring the game, and a deck of circular playing cards for indicating the plays, said plurality of mechanical playing pieces are of cylindrical and solid configuration, with a human face inscribed on the top and half of said plurality of mechanical playing pieces include an elongated slot in the right side of their outer peripheries, and the other half of said plurality of mechanical playing pieces include an elongated slot in the left side of their outer peripheries, and in the elongated slots are a pivotal and simulated baseball bat, which is secured, at one end, by pivot pin means, in the bottom of the elongated slots, and one half of said plurality of mechanical playing pieces are used by one player, and the other half are used by the opposing player, said plurality of mechanical playing pieces being designated as right hand batters and left hand batters.

2. Then combination according to claim 1, wherein said plurality of mechanical playing pieces are moved upon said game board by the respective players, by the selection of cards from said deck of cards, and a baseball diamond, inscribed in the center of said game board, includes a pair of boxes, one on each side of home plate, each being a different color, and each base in the corner areas of said baseball diamond are divided into two colors.

3. The combination as set forth in claim 2, wherein each said base divided into two colors comprises a pair of boxes adjacent each other and located at a corner of said diamond, each said box being a different color than the adjacent other.

* * * * *